US010493498B2

(12) United States Patent
Duan et al.

(10) Patent No.: US 10,493,498 B2
(45) Date of Patent: Dec. 3, 2019

(54) METHOD FOR ARRANGING JET CLEANING NOZZLES

(71) Applicant: BAOSHAN IRON & STEEL CO., LTD., Shanghai (CN)

(72) Inventors: Mingnan Duan, Shanghai (CN); Shanqing Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 15/882,731

(22) Filed: Jan. 29, 2018

(65) Prior Publication Data

US 2018/0147608 A1 May 31, 2018

Related U.S. Application Data

(62) Division of application No. 14/429,725, filed as application No. PCT/CN2012/001628 on Dec. 5, 2012, now abandoned.

(30) Foreign Application Priority Data

Sep. 25, 2012 (CN) ..... 2012 1 0362387

(51) Int. Cl.

| | |
|---|---|
| ***B08B 3/00*** | (2006.01) |
| ***B08B 3/02*** | (2006.01) |
| ***B21B 45/02*** | (2006.01) |
| *B21B 45/08* | (2006.01) |

(52) U.S. Cl.

CPC ..... *B08B 3/02* (2013.01); *B08B 3/00* (2013.01); *B08B 3/022* (2013.01); *B21B 45/0275* (2013.01); *B21B 45/08* (2013.01); *Y10T 29/49401* (2015.01)

(58) Field of Classification Search

CPC ..... B08B 3/02; B08B 3/022; B21B 45/0275; B21B 45/08; Y10T 29/49401

See application file for complete search history.

(56) References Cited

U.S. PATENT DOCUMENTS 8,042,558 B2 * 10/2011 Kuge ..... B08B 3/022 134/122 R

* cited by examiner

*Primary Examiner* — Rick K Chang

(74) *Attorney, Agent, or Firm* — Eversheds Sutherland (US) LLP

(57) ABSTRACT

A method for arranging jet cleaning nozzles comprising: arranging multiple rows of nozzles in a parallel and uniform manner along a lengthwise direction of a metal plate strip; arranging the nozzles in each row at an equal interval; arraying adjacent rows of nozzles in a staggered manner along the widthwise direction of the metal plate strip so as to form a nozzle matrix; wherein each nozzle is perpendicular to a moving direction of the metal plate strip, and the perpendicular distance of each nozzle to a surface of the metal plate strip is the same. Through the method for arranging jet cleaning nozzles, nozzles can be flexibly controlled based on the change of the geometric relationship between nozzles, in order to implement efficient and continuous descaling on the surfaces of a metal plate strip with different width specifications and different requirements on the descaling speed. In this way, waste of energy and water resources occurred when changing specifications is avoided, and the phenomenon that upper and lower nozzles spray to each other is also avoided, thereby achieving flexible and efficient control over the arrangement mode of jet cleaning nozzles for descaling.

9 Claims, 5 Drawing Sheets

METHOD FOR ARRANGING JET CLEANING NOZZLES

CROSS REFERENCE TO RELATED APPLICATIONS

This application is a divisional of U.S. patent application Ser. No. 14/429,725, filed Mar. 19, 2015 which is a National Stage Entry of International Application No. PCT/CN2012/001628, filed Dec. 5, 2012. The contents of these applications are hereby incorporated by reference in their entirety.

TECHNICAL FIELD

The present invention relates to a jet flow cleaning technology, especially relates to a method for arranging jet cleaning nozzles, which is mainly used for conducting continuous cleaning to corrosion layer and adhesion on the surface of cold state hot-rolled steel sheets of different width specifications, so as to ensure that the scale skin on the whole plate width can be removed efficiently and partly scale skin remaining on the surface can be completely eliminated when a strip steel of different width specifications in a continuous descaling, so as to enhance the flexibility and effect of the jet flow descaling.

BACKGROUND

When using jet flow to conduct descaling to the metal surface, as the metal plate strip has a greater width value, it is usually hard to cover the whole width when using single nozzle to conduct rust removal or descaling, so a plurality of nozzles of the same type and same geometrical fixing manner are continuously arranged in a staggered manner in the widthwise direction of the metal plate strip. Therefore, evenly distributed and steady descaling can be achieved when the metal plate strip is passing through the region covered by nozzles. While regarding to the continuous descaling production line, in order to enhance the descaling efficiency and ensure the continuous descaling, after opening each roll of metal plate strip, usually conducting fast welding between heads and tails of each roll to achieve a headless metal plate roll with infinite length so as to always ensure continuous feeding for follow-up process section. This kind of technical manner can be called as continuous descaling (or continuous metal surface processing).

This kind of continuous descaling, due to a certain difference between width specification and thickness specification of each plate roll, such as, an continuous acid-rolling line of a steel company, whose steel plate width specification of incoming materials is frequently switched between 550~1050 mm, descaling stability of such frequently switched width value can be easily assured with respect to traditional acid pickling descaling, while it brings great influence regarding to using the jet flow physical descaling technology. This influence is mainly embodied in following aspects:

1. Established number of the nozzles must take the widest width specification as the object, and the nozzles need to be arranged are numerous.

2. When processing the plate strip of narrow specification, nozzles positioned at side portions beyond the plate width will still continue to spray, which causes great waste of electric energy and water resource.

3. The nozzles beyond the plate width are symmetrically arranged on both sides of the plate strip, they will directly spray to each other face to face when spraying; great spray force will directly cause mutual damage to both of them, which will seriously reduce the service life of the nozzle.

Based on above problems, different solving methods are specifically designed in the prior art: such as a inclined arranging manner used in Japanese patent JP55100814A, which aims to conduct integral incline to the nozzle arranged on the whole width surface based on widening or narrowing when the size specification of the plate width is switched, so as to ensure that the cleaning surface is wholly covered. However, this kind of arranging manner has very strict requirements to the strength distribution of nozzle jet flow, for the reason, after the inclined angle has changed, its former evenly distributed strength rule is broken, and the strength distribution characteristic of each nozzle is not able to strictly satisfy the even distribution of strength while jet flow of each nozzle does not interfere with each other when inclining different angles.

There is also technical solution provided by the prior art to aim at nozzle arrangement, such as conducting removal of hot rolling scale skin, cooling of continuous casting and so on by using high-pressure water, in which the nozzle arrangement mainly uses traditional straight arranging manner with respect to the largest width specification.

SUMMARY

The object of present invention is design a method for arranging jet cleaning nozzles, according to which, the nozzles can be flexibly controlled, and the efficient and continuous descaling to the surfaces of metal plate strips that have different width specifications and different requirements on the descaling speed can be achieved based on the change of the geometric relationship between nozzles. In this way, waste of energy and water resources during switch of specifications is eliminated, and the phenomenon that upper and lower nozzles spray to each other is also eliminated, thereby achieving flexible and efficient control over the arrangement mode of nozzles for descaling.

Specifically, a method for arranging jet cleaning nozzles, multiple rows of nozzles are in a parallel manner and uniformly arranged along the lengthwise direction of a metal plate strip, the nozzles in each row are arranged at an equal interval, two adjacent rows of nozzles are arrayed in a staggered manner along the widthwise direction of the metal plate strip so as to form a nozzle matrix; each nozzle is perpendicular to a moving direction of the metal plate strip, and a perpendicular distance of each nozzle to a surface of the metal plate strip is same.

Furthermore, mutual interference between jet flows of adjacent nozzles in the same row does not happen.

Mutual interference between jet flows of two adjacent rows of nozzles does not happen in a lengthwise direction of the metal plate strip, that is, between front and rear nozzles.

In the widthwise direction of the metal plate strip, that is a X direction, a separation distance between nozzles in each row is 2a; a separation distance between nozzles from two adjacent rows of nozzles in a plate widthwise direction is a.

In a moving direction of the metal plate strip, that is a Y direction, a separation distance between two adjacent rows of nozzles is b, and a value of b should satisfy that there is non-mutual interference between jet flows of two adjacent rows of nozzles.

When a width of the metal plate strip in production line changes and produces a metal plate strip of a certain target width in a width range of cleaning, in order to assure that all nozzles can conduct efficient descaling to the plate, the nozzle is adjusted as follows:

in the a vertical direction of the a surface of the plate, that is namely the a Z direction, the moving distance is Δc, setting a direction close to the metal plate strip as negative moving, the a value of Δc is a negative value in this situation; a direction away from the surface of the plate is positive moving, a Z value is a positive value in this situation; so that, the calculation formula is:

$$\Delta c = \{[(L_1 - L_0) \times ctg\alpha]/n\} \cdot (1 + K)$$

in the formula:

$L_0$—a basic width value of the metal plate strip, mm;

$L_1$—an adjusting target width value of the metal plate strip, mm;

α—a unilateral divergence angle of jet flow symmetric section of the nozzle, which is determined by properties of the nozzle, degree;

n—the number of nozzles of two adjacent rows; K—a compensation coefficient of a jet flow characteristic of nozzles −0.5~0;

in a vertical direction of the surface of the metal plate strip, that is namely a Z direction, setting a moving distance as Δc, setting a direction moving close to the metal plate strip as a negative movement, wherein a value of Δc is a negative value; setting a direction moving away from the surface of the metal plate strip as a positive movement, a value of Z is a positive value; wherein the following formula is satisfied:

$$\Delta a = (L_1 - L_0)/(n-1)$$

Furthermore, the nozzles in each row are parellelly arranged in more than one column along the lengthwise direction of the metal plate strip, so as to form a longitudinal nozzle unit which can be adjusted individually.

A jet flow divergence angle of the nozzle is: $0<\alpha<45°$.

An axis of the nozzle is in a plane which is parallel to a strip moving direction of the metal plate strip and vertical to the surface of the metal plate strip; and an angle β is between the axis of the nozzle and a vertical line of the metal plate strip, of which the value range is $0<\beta<50°$.

Two kinds of mediums pass through the nozzle simultaneously, one is liquid water, and the other is hard particles After the metal plate strip of the widest specification which needs to be cleaned has entered the jet flow descaling unit in the present invention, the nozzle unit will be evenly disturbed according to the cleaning surface strength distribution and the jet flow affected range of each nozzle, which aims to cover the plate width as large as possible, and ensure the jet flow between each nozzle not to cause mutual interference in the widthwise direction, namely the X direction; at the same time, being evenly disturbed according to the cleaning strength distribution and the jet flow affected range of each nozzle, the nozzle must give consideration to the affected range and strength of other nozzles and the nozzles in the front and rear row are arranged in a staggered manner.

Provided that the present invention is based on above kinds of geometric positional changing rule, flexible switching for different plate width specifications can be realized.

With respect to prior art, the present invention has following advantages:

1. The present invention uses a nozzle matrix, the whole nozzle matrix can be flexibly controlled and always entirely cover the surface of different plate width respectively, so that the descaling section will not affect the production technology pace of the upstream and downstream of the metal plate strip, which will obviously enhance the productivity of the manufacturer.

2. The present invention has eliminated the empty spray and mutual spray of part of nozzles at side portions, which can obviously enhance the service life of nozzles at side portions and greatly reduce the waste of energy, and the production cost of manufacturing enterprises can be directly reduced.

3. The present invention is based on the strength distribution rule of the nozzle itself, which is always premised on the even distribution of strength of the plate width direction so as to reasonably control the distance between the transverse and longitudinal nozzles and spray target distance. It aims to reach a highest cleaning efficiency of nozzles to any different plate width on the production line.

EMBODIMENTS

Figure 1:
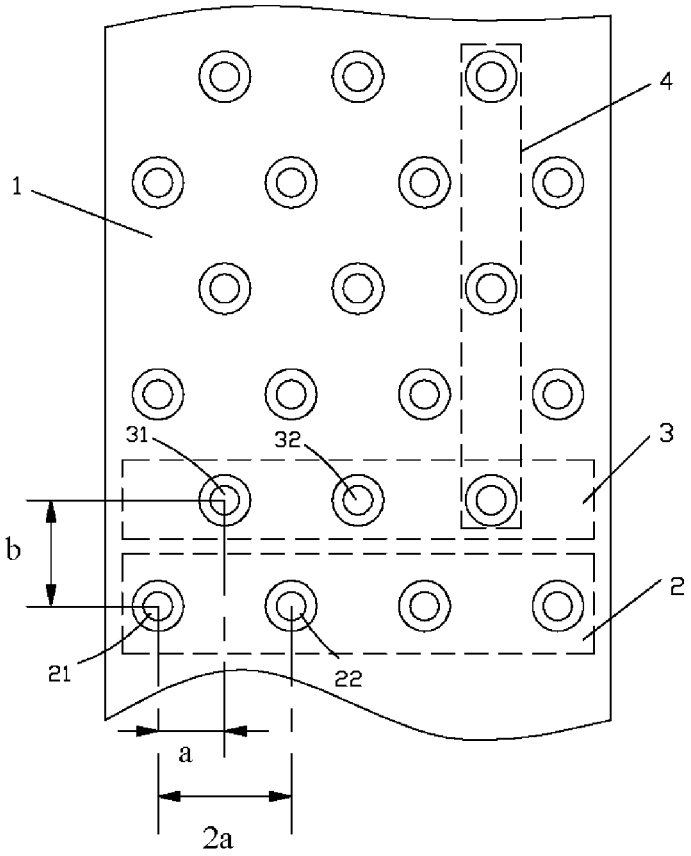
FIG. 1 is a top view illustrating the nozzle arrangement in the embodiment of cleaning metal plate strip of wide specification according to the method of present invention.
Figure 2:
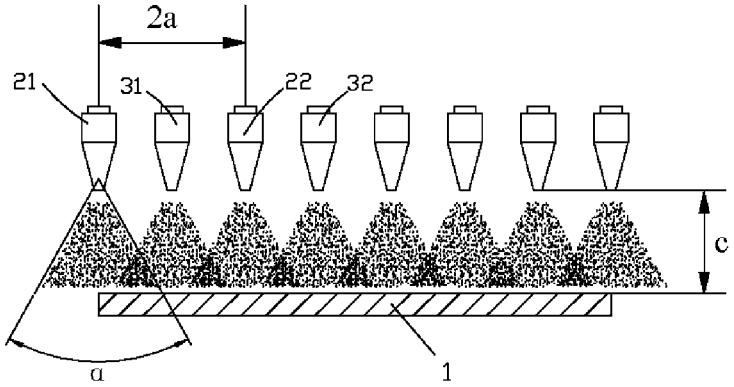
FIG. 2 is a side view illustrating the nozzle arrangement in the embodiment of cleaning metal plate strip of wide specification according to the method of present invention.
Figure 3:
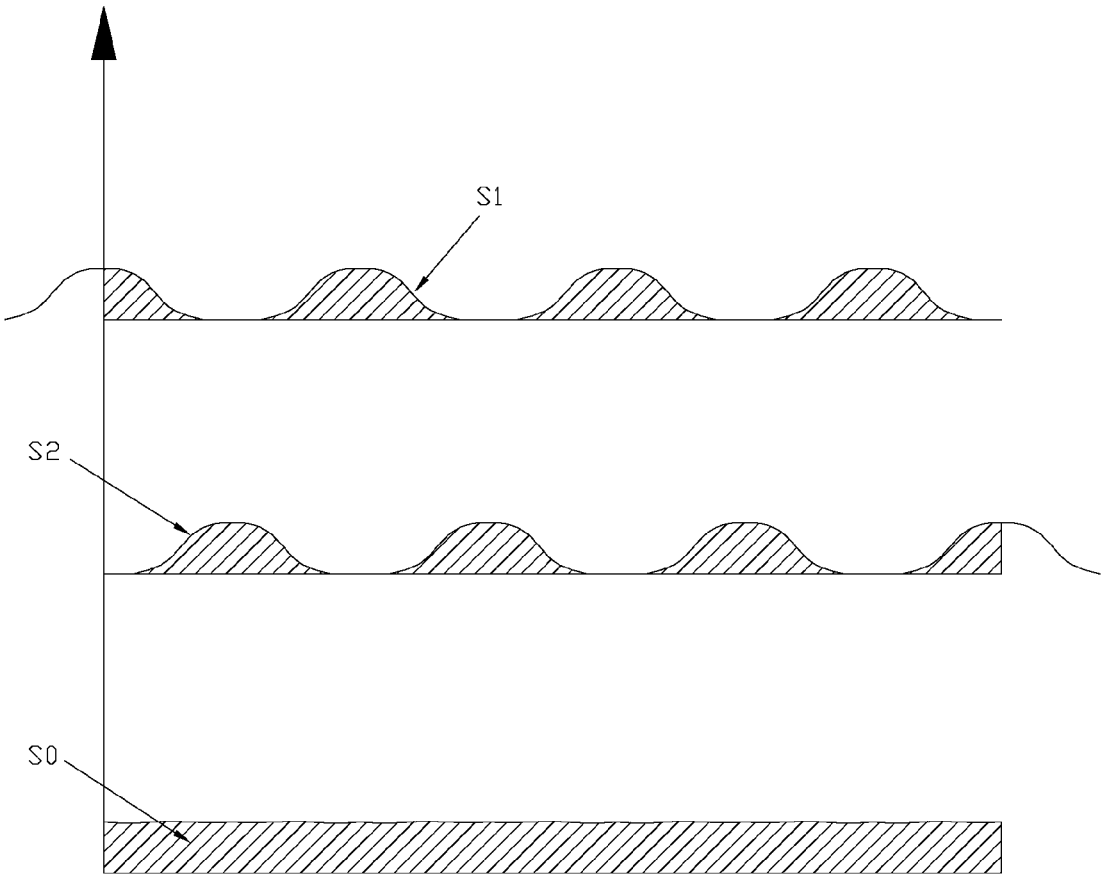
FIG. 3 is a view illustrating the distribution of the nozzle spray strength in the embodiment of cleaning metal plate strip of wide specification according to the method of present invention.

A method for arranging jet cleaning nozzles according to the present invention, as shown in FIGS. 1-3, multiple rows of nozzles are in a parallel manner and uniformly arranged along the lengthwise direction of a metal plate strip 1. In the present embodiment, each nozzle 21, 22 or 31, 32 in the first row of nozzles 2 and the second row of nozzles 3 are arranged at an equal interval. Two adjacent rows of nozzles are arrayed in a staggered manner along the widthwise direction of the metal plate strip 1 so as to form a nozzle matrix. Each nozzle is perpendicular to a moving direction of the metal plate strip 1. The perpendicular distance of nozzles 21, 22, 31, 32 to the surface of the metal plate strip 1 is same.

Preferably, mutual interference between jet flows of adjacent nozzles 21, 22 or 31, 32 in the same row does not happen; and mutual interference between jet flows of two adjacent rows of nozzles 2, 3 does not happen in a lengthwise direction (Y direction) of the metal plate strip 1, namely that is, between two adjacent nozzles 21, 32.

In the widthwise direction of the metal plate strip 1, that is namely the X direction, a separation distance between nozzles 21, 22 in each row is 2a; the a separation distance of nozzles 21, 32 from two adjacent rows of nozzles 2, 3 is a.

Hereby cite the scale skin removal of the cold state hot-rolled steel sheet surface as an example, of which the embodiments are as follows:

A spray pressure of the nozzle is set at 30~80 MPa, and a flow rate of each nozzle is at a level of 10 L/min~60 L/min.

Regarding to a cleaning for a strip steel with a width of 1000 mm, the first row of nozzles need to be arranged with 10 nozzles, the second row of nozzles also need to be arranged with 10 nozzles, and a offset distance between two nozzles is 50 mm; a spray distance Z of the nozzle is kept at a level of 120 mm to spray.

A jet flow divergence angle α of each nozzle is 30°, of which the strength distribution obeys the normal distribution rule, as shown in the FIG. 3. Wherein, S1 is the strength of the first row of nozzles, S2 is the strength of the second row of nozzles, and S0 is a strength distribution after overlapping two rows of nozzles. By such arrangement and adjusting manner of the nozzle matrix, a fast switching to a steel plate of another width can be realized after descaling of a whole surface of the steel plate of one certain width, and the descaling of a whole surface of the steel plate after switching can also be realized, which will greatly enhance the service efficiency of each nozzle and eliminate the waste of useless jet flow spray and other phenomenon.

Figure 4:
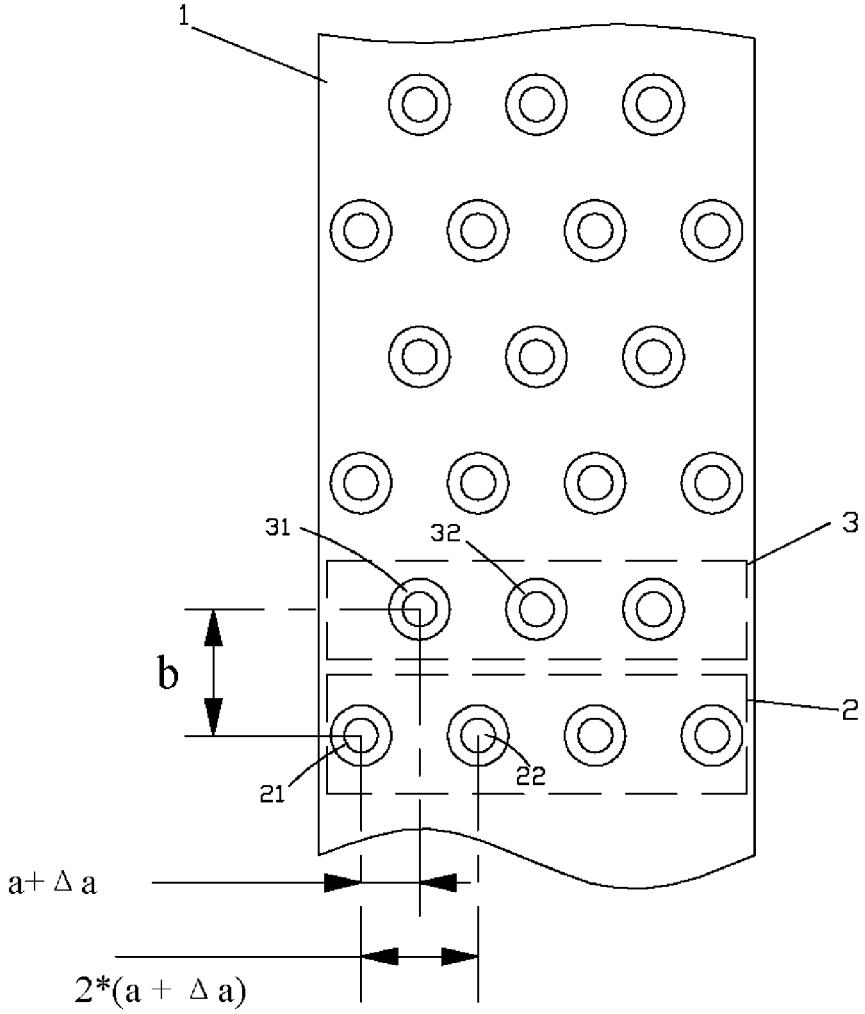
FIG. 4 is a parameter diagram of the nozzle arrangement when cleaning metal plate strip of narrow specification according to the method of present invention.
Figure 5:
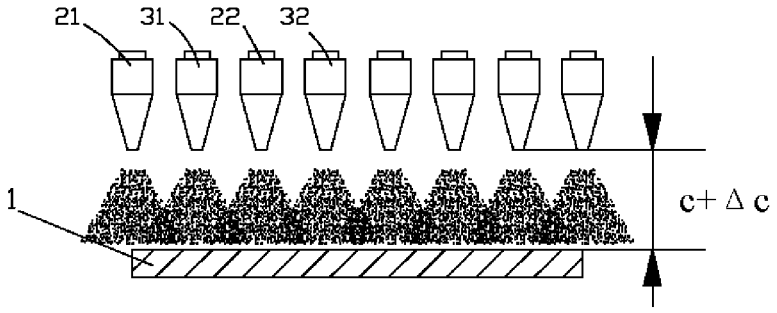
FIG. 5 is a parameter diagram of the nozzle arrangement when cleaning metal plate strip of narrow specification according to the method of present invention.
Figure 6:
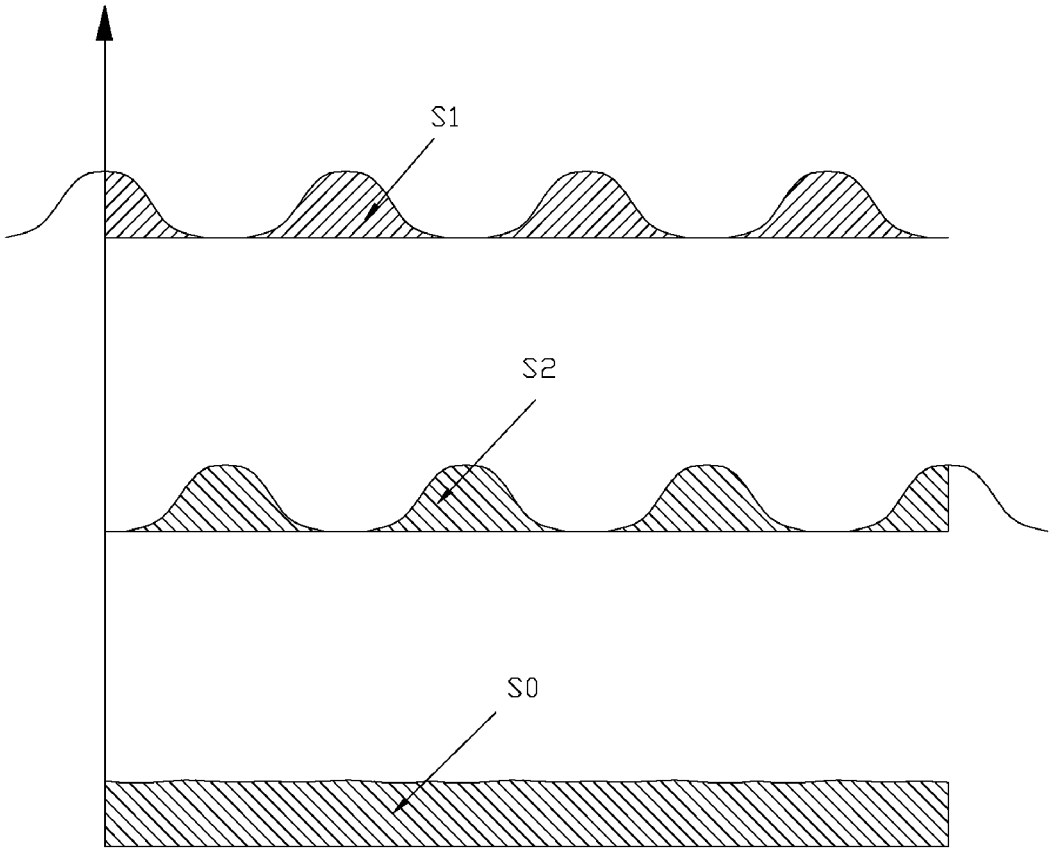
FIG. 6 is a distribution diagram of the nozzle spray strength when cleaning metal plate strip of narrow specification according to the method of present invention.

As shown in FIGS. 4-6, when the width value of the strip steel being in cleaning is switched from original 1000 mm to 500 mm, a variation rules of the a, b, c value of each nozzle are as follows:

$$\Delta c = \{[(500-1000)\times ctg15]/20\}\cdot(1+K)$$

$$\Delta c = -75\text{ mm}$$

in the formula: K—a jet flow influence coefficient of a nozzle, just take "−0.2".

At the moment, a spray target distance of a nozzle of narrow specification is changed into:

$$c=120-75=45\text{ mm}$$

Similarly, it can be calculated that the value of a, b after adjustment is:

$$\Delta a = \frac{1}{2}\cdot[(500-1000)/(10-1)] = -27.78\text{ mm}$$

$$\Delta b = 0\text{ mm}$$

In this way, it is realized that the nozzle matrix unit is switched from a cleaning manner of 1000 mm to a cleaning manner of 500 mm During this period, there is no need to conduct any adjustment to the pressurized system, pipeline and so on, which greatly enhances the technical control ability and improves the production efficiency.

As shown in FIG. 1, said nozzles in each row are arranged in a parallel manner in more than one column along the lengthwise direction of the metal plate strip 1 (Y direction), so as to form a longitudinal nozzle unit 4 which can be adjusted individually.

Figure 7:
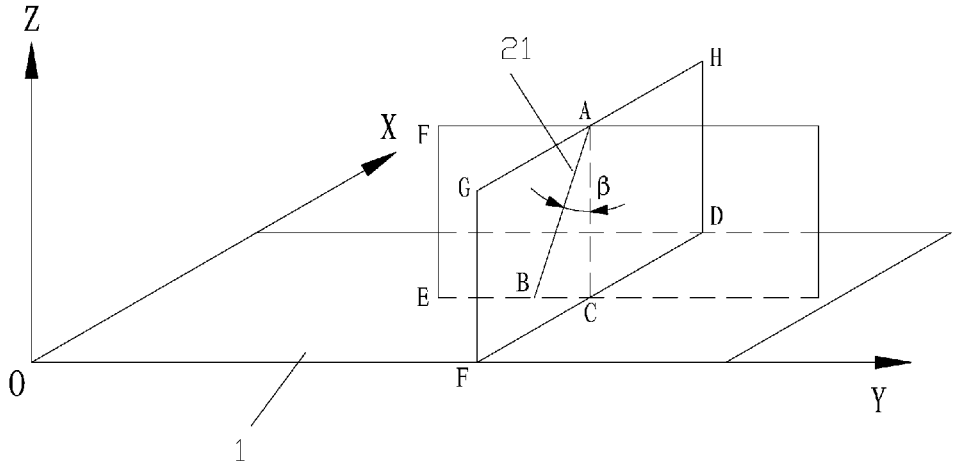
FIG. 7 is a structure diagram between the nozzle and the metal plate strip according to the method of present invention.

As shown in FIG. 7, a axis of said jet nozzle 21 (citing the jet nozzle 21 as an example, other are the same) is AB line, and a direction of the jet flow is: from A to B; the direction of the jet flow AB within a plane ACEF parallel to a strip moving direction of the strip steel (the metal plate strip 1) and vertical to the surface of the metal plate strip; and there is an included angle β between the axis of the nozzle 21 (AB line) and a vertical line AC of the metal plate strip 1, of which the value range is 0<β<50°.

The present invention fully uses the jet flow characteristic and the strength distribution characteristic of the nozzle, so as to realize a swift adjustment of the nozzle matrix when cleaning the metal strip plate surface. Especially, it can enhance the surface cleaning efficiency of the metal strip plate, decrease unnecessary loss of energy and greatly reduce abnormal damage of partial device. Therefore, the present invention has wide application prospect in the field of surface descaling technology. The present invention is not only adapted to the surface descaling and rust removal of cold state metal strip plate, but also can be applied to technical field of coating, nozzle cooling, spray lubrication, etc.

The invention claimed is:

1. A method for arranging jet cleaning nozzles comprising:

arranging multiple rows of the jet cleaning nozzles in parallel along a lengthwise direction of a metal plate strip;

arranging the jet cleaning nozzles in each of the multiple rows of the jet cleaning nozzles at an equal interval;

arraying two adjacent rows of the multiple rows of the jet cleaning nozzles in a staggered manner along a widthwise direction of the metal plate strip so as to form a nozzle matrix, wherein each of the jet cleaning nozzles is perpendicular to a moving direction of the metal plate strip, and a perpendicular distance of each jet cleaning nozzle to a surface of the metal plate strip is the same, wherein when a width of the metal plate strip in a production line changes and produces a metal plate strip of a certain target width in a width range of cleaning, in order to assure that all jet cleaning nozzles can conduct efficient descaling to the metal plate strip, the jet cleaning nozzles comprises following adjustment:

in a vertical direction of the surface of the metal plate strip, that is namely a Z direction, setting a moving distance as Δc; setting a direction moving close to the metal plate strip as a negative movement, wherein a value of Ac is a negative value; setting a direction moving away from the surface of the metal plate strip as a positive movement, a value of Ac is a positive value; wherein the following formula is satisfied:

$$\Delta c=\{[(L_1-L_0)\times ctg\alpha]/n\}\cdot(1+K)$$

wherein:

$L_0$—a basic width value of the metal plate strip, mm, $L_1$ an adjusting target width value of the metal plate strip, mm, α—a unilateral divergence angle of jet flow symmetric section of the jet cleaning nozzle, which is determined by a property of the jet cleaning nozzle, degree;

n—the number of jet cleaning nozzles of two adjacent rows; K—a compensation coefficient of a jet flow characteristic of the jet cleaning nozzles −0.5~0;

in the widthwise direction of the metal plate strip i.e. an X direction, each row of the jet cleaning nozzles has a central line of the plate width as a symmetry center, and when the jet cleaning nozzles move close to the center line of the plate width, a distance between adjacent two jet cleaning nozzles in each row changes with a variation 2Δa, which is satisfied by:

$$\Delta a=(L_1-L_0)/(n-1).$$

2. The method for arranging jet cleaning nozzles according to claim 1, wherein jet flows of adjacent jet cleaning nozzles in a same row have no mutual interference.

3. The method for arranging jet cleaning nozzles according to claim 1 or 2, wherein in the lengthwise direction of the metal plate strip, jet flows of adjacent rows of jet cleaning nozzles have no mutual interference.

4. The method for arranging jet cleaning nozzles according to claim 1, wherein in the widthwise direction of the metal plate strip, that is the X direction, a separation distance between jet cleaning nozzles in each row is 2a; and a separation distance between nozzles from two adjacent rows of nozzles in the widthwise direction of the metal plate strip is a.

5. The method for arranging jet cleaning nozzles according to claim 1, wherein in the moving direction of the metal plate strip, that is a Y direction, a separation distance between two adjacent rows of jet cleaning nozzles is b, and a value of b satisfies non-mutual interference between jet flows of two adjacent rows of nozzles.

6. The method for arranging jet cleaning nozzles according to claim 1, wherein the jet cleaning nozzles in each row are arranged parallel in more than one or more columns along the lengthwise direction of the metal plate strip, so as to form longitudinal nozzle columns which can he adjusted respectively.

7. The method for arranging jet cleaning nozzles according to ally on of claim 1, wherein a jet flow divergence angle of each jet cleaning nozzle is: $0<\alpha<45'$.

8. The method for arranging jet cleaning nozzles according to claim 1, wherein an axis of the jet cleaning nozzle is in a plane which is parallel to the moving direction of the metal plate strip and vertical to the surface of the metal plate strip; and an angle β is between the axis of the jet cleaning nozzle and a vertical line of the metal plate strip, of which the value range is $0<\beta<50°$.

9. The method for arranging jet cleaning nozzles according to claim 1, wherein two different kinds of mediums pass through the jet cleaning nozzles simultaneously, a first medium is liquid water, and a second medium is hard particles.

* * * * *